US005323964A

United States Patent [19]

Doszpoly et al.

[11] Patent Number: 5,323,964

[45] Date of Patent: Jun. 28, 1994

[54] HIGH PRESSURE UNIT FUEL INJECTOR HAVING VARIABLE EFFECTIVE SPILL AREA

[75] Inventors: Bela Doszpoly; Laszlo Tikk; Yul Tarr, all of Columbus; Leonard Hummel, Shelbyville, all of Ind.

[73] Assignee: Cummins Engine Company, Inc., Columbus, Ind.

[21] Appl. No.: 861,005

[22] Filed: Mar. 31, 1992

[51] Int. Cl.[5] ..... F02M 45/08

[52] U.S. Cl. ..... 239/95; 239/533.8; 239/88; 239/91

[58] Field of Search ..... 239/5, 88, 89, 91, 95, 239/533.8

[56] References Cited

U.S. PATENT DOCUMENTS

| | | | |
|---|---|---|---|
| 4,006,859 | 2/1977 | Thoma | 239/89 |
| 4,249,499 | 2/1981 | Perr . | |
| 4,396,151 | 8/1983 | Kato et al. . | |
| 4,410,138 | 10/1983 | Peters et al. . | |
| 4,427,152 | 1/1984 | Sisson et al. . | |
| 4,471,909 | 9/1984 | Perr . | |
| 4,537,352 | 8/1985 | Kato et al. | 239/91 X |
| 4,699,320 | 10/1987 | Sisson et al. . | |
| 4,721,247 | 1/1988 | Perr . | |
| 4,948,049 | 8/1990 | Brisbon et al. | 239/91 |
| 4,951,631 | 8/1990 | Eckert . | |
| 4,986,472 | 1/1991 | Warlick et al. . | |
| 5,125,580 | 6/1992 | Kronberger | 239/533.8 X |

FOREIGN PATENT DOCUMENTS

| | | | |
|---|---|---|---|
| 293171 | 7/1928 | United Kingdom | 239/95 |

*Primary Examiner*—Andres Kashnikow
*Assistant Examiner*—William Grant
*Attorney, Agent, or Firm*—Sixbey, Friedman, Leedom & Ferguson

[57] ABSTRACT

A fuel injector includes an injector housing having a plunger assembly disposed within a central axial bore and including a lower plunger, an intermediate plunger, and an upper plunger. The lower plunger reciprocates within the central bore to meter a variable quantity of fuel and to inject this fuel during downward portions of the reciprocating motion. A timing chamber formed between the upper and intermediate plungers receives an amount of timing fluid to create a variable length hydraulic link between the plungers. The fluid is drained from the chamber through a drain passage at the end of the injection cycle. The timing chamber has associated with it a mechanism for changing the effective flow function of the drain passage, at a point in the cycle following fuel injection, to maintain a large downward pressure on the lower plunger to hold the lower plunger down and thus prevent additional, undesired fuel flow into the combustion chamber. In a preferred embodiment, the drain passage is located along the central axis of the intermediate plunger, and the upper plunger is provided with a projecting portion which moves into position as the timing chamber collapses to effectively constrict the drain passage, thus changing the timing fluid flow function to a function which provides greater fluid pressure in the timing chamber.

41 Claims, 11 Drawing Sheets

STAGE 1
INJECTION

STAGE 2
SPILLPORT OPENING

STAGE 3
SPILLPORT FULLY OPEN

STAGE 4
PROJECTION ENGAGEMENT

STAGE 5
FULL THROTTLING

STAGE 6
FINAL THROTTLING

HIGH PRESSURE UNIT FUEL INJECTOR HAVING VARIABLE EFFECTIVE SPILL AREA

FIELD OF THE INVENTION

The present invention relates to unit fuel injectors having a nozzle and a reciprocating injection plunger that is mechanically actuated by an engine camshaft. More particularly, the present invention relates to a hydraulically variably timed unit injector having means for changing the effective flow function of the drain passage, at a point in the cycle following fuel injection, to maintain a large downward pressure on the lower plunger to hold the lower plunger down and thus prevent additional, undesired fuel flow into the combustion chamber.

BACKGROUND OF THE INVENTION

The need for increased fuel economy and improved pollution control have caused designers of internal combustion engines to seek substantially improved fuel supply systems. In response, unit fuel injectors providing precise, reliable and independent control over injector timing and metering have been developed and are widely used.

Fuel injectors of the "unit" type, such as shown in U.S. Pat. No. 4,471,909 to Perr, have a nozzle and a reciprocating injection plunger mechanically actuated by an engine camshaft to force fuel from the nozzle. The camshaft produces an advancing or downward force on the injector plunger (the direction toward the combustion chamber will be referred to herein as advanced or downward, although the injectors could be mounted with any physical orientation).

While effective for their intended purposes, such unit injectors were only designed to achieve injection pressures in the range of 15,000 to 20,000 psi. This range is not necessarily sufficient to achieve the high performance, low fuel consumption, and minimal pollution demanded of modern diesel engines.

In response to this increased performance requirement, very high pressure unit injectors have been designed. One such type of unit injector is shown in the commonly assigned U.S. Pat. Nos. 4,986,472 to Warlick et al. and 4,721,247 to Perr. These injectors have an injector housing with a plunger assembly disposed within a central axial bore. The plunger assembly includes a lower plunger, an intermediate plunger, and an upper plunger. The lower plunger reciprocates within the central bore to cause a variable quantity of fuel to be first metered and then subsequently injected into the engine during downward portions of the reciprocating motion of the plunger assembly. A timing chamber formed between the upper and intermediate plungers receives timing fluid during the metering phase of the injection cycle so as to create a variable length hydraulic link between the upper and intermediate plungers. The amount of timing fluid can be adjusted to vary the timing of the fuel injection for enhanced engine operation. Injectors of this general type can be manufactured either as "open nozzle" unit fuel injectors or as "closed-nozzle" types having a pressure-operated valve mechanism for opening and closing the injector spray holes.

In high-pressure unit injectors, SAC pressures (the pressure of the fuel in the injection chamber just above the injector spray holes) as high as 30,000 psi or more are desired to assure complete fuel atomization. When an injector is designed to achieve very high SAC pressures at low engine speeds, there arises a danger that excessive loads will develop in the injector drive train. To control the upper limit of injection pressure, a pressure responsive valve such as disclosed in the '247 or '472 patents may be provided to drain timing fluid during downward movement of the upper plunger. Provision of a pressure-limiting valve allows the unit injector and associated camactuated drive train to be designed to provide extremely high injection pressures, for example up to 30,000 psi, even at low engine speed, without risking excessive pressure at higher engine speeds. The timing fluid which remains in the timing chamber as the lower plunger reaches its lowermost position must, of course, be discharged. It is desirable to "throttle" this discharge, however, to create a high "blowdown load" or pressure on the lower plunger to prevent the lower plunger from bouncing back at the end of its travel. Such undesirable bouncing of the lower plunger can cause secondary end-of-injection "dribbling of fuel" which can cause insufficient fuel combustion, pollution, and poor fuel economy.

To achieve a desired degree of blowdown load, a pressure release valve such as disclosed in U.S. Pat. No. 4,249,499 has been provided, adapted to operate at the termination of injection. Such a valve would need, however, to have a different operating characteristic from that of the pressure relief valve of the '247 and '472 patents, which have valves designed to operate during the fuel injection event, i.e. where the lower plunger has yet to reach its lowermost position. Two such pressure relief valves, having different operating characteristics, would necessarily conflict.

This dilemma was partially solved in the '472 patent by providing a spillport located axially in the injector body so as to communicate with the timing chamber only when the lower plunger has very nearly reached its lowermost position. Careful control over the position and size of the spillport, plus control over the shape of the plunger profile which controls flow through the spillport (see FIGS. 14(*a*)–14(*c*) and columns 14–16 of the '472 patent) can result in highly desirable end-of-injection blowdown loads. As shown in the drawings of this patent, the pressure within the timing chamber of this type of injector would inherently be nonsymmetrical with respect to the injector central axis during blowdown. This lack of symmetry could lead to uneven wear.

Inherently, however, pressure produced by prior injector designs during blowdown is a function of engine speed. At low engine speeds in particular, this reduction in blowdown pressure may still permit an undesired upward movement of the lower plunger after injection of the metered fuel has been completed. This upward movement results in secondary injection, which is the leakage of additional, undesired fuel into the combustion chamber following termination of the main injection event. Because this secondary injection fuel is introduced too late in the combustion cycle to be burned effectively, it enters the engine exhaust stream as an incompletely combusted hydrocarbon component. This results in vehicle emissions characteristics that are undesirable in environmental terms. Also, this secondary injection fuel performs no useful work; thus, the secondary injection phenomenon results in poorer fuel economy than could be attained with a clean cutoff of injection.

The problem of secondary injection has sometimes been addressed by continuing to move the upper injector plunger downwardly after the upper plunger physically contacts the lower plunger and the lower plunger reaches its nominal end-of-travel position. In such injector systems, the lower part of the plunger .is actually "overdriven" to resiliently compress the injector drive train and temporarily deform the injector housing. The use of such large overtravel forces results in increased wear and fatigue effects on system components. As a result, injector components must be constructed more ruggedly and to closer manufacturing tolerances than would otherwise be needed, and the costs of manufacturing and repairing the injection system are increased.

Despite notable advancements achieved before, it has not been possible to produce a minimum-cost, highly reliable, hydraulically variably timed unit injector which form a blowdown pressure sufficient over a broad range of engine speeds to prevent secondary injection. Therefore, there is a need for a novel and improved unit injector design which meets these criteria.

SUMMARY OF THE INVENTION

Therefore, it is a general object of the present invention to provide an improved unit fuel injector capable of maintaining a blowdown pressure sufficient to prevent secondary injection over a broad range of engine speeds.

A further general object of the present invention is to provide an improved unit fuel injector with increased reliability.

Another general object of the present invention is to provide an improved unit fuel injector which minimizes fuel consumption and undesirable emissions in an internal combustion engine.

A more specific object of the present invention is to provide a high pressure unit injector including a collapsible timing chamber formed below said upper plunger and above said lower plunger and further including multistage drain force varying means for varying timing chamber fluid backpressure according to a first function during a first part of the injection portion of the combustion cycle, and according to a second, different function during a second part of the injection portion.

Another object of the present invention is to provide a high pressure unit injector having a cavity formed in a collapsible timing chamber, and a projection extending from the bottom of the upper plunger which interacts with said cavity to regulate timing fluid spill flow.

It is also an object of the present invention to provide a fuel injector with a projecting surface located on an upper plunger and a drain passage located on said lower plunger, wherein the projecting surface and the drain passage interact to regulate timing fluid spill flow during a later part of an injection cycle.

Yet another object of the present invention is to provide a fuel injector which includes an intermediate plunger between an upper plunger and a lower plunger, with a drain passage located in the intermediate plunger and a projecting surface extending from a lower surface of the upper plunger so that the projecting surface interacts with the drain passage to regulate timing fluid spill flow.

Another object of the present invention is to provide a fuel injector in which a timing fluid drain passage is located centrally axially in a plunger and a projection from another injector component interacts with the timing fluid drain passage to regulate timing fluid spill flow.

Still another objective of the present invention is to provide a blowdown pressure regulating mechanism which provides a symmetrical blowdown force relative to the contral axis of the injector.

An additional object of the present invention is to provide a fuel injector which has a timing fluid regulating projection with a substantially cylindrical shape.

A further object of the present invention is to provide a fuel injector which has a timing fluid regulating projection with a beveled lowermost edge.

Another object of the present invention is to provide a fuel injector which has a timing fluid regulating projection with a rounded lowermost edge.

Yet another object of the present invention is to provide a fuel injector which has a timing fluid regulating projection with a substantially conical shape, either including a portion of the frustrum of a cone or including the apex of the cone.

An additional object of the present invention is to provide a fuel injector which has a timing fluid regulating projection with a substantially hemispherical shape.

Another important object of the present invention is to provide a fuel injector including a timing chamber with a fluid exit having an effective area for permitting escape of fluid from the timing chamber, and interference means which reduce the effective area of the fluid exit means at a specified time during the collapse of the timing chamber.

These objects, and others which will be apparent to those skilled in the art upon examination of the specification in conjunction with the drawings and claims, are achieved in the present invention by providing a fuel injector which includes an injector housing having a plunger assembly disposed within a central axial bore, the plunger assembly including a lower plunger, an intermediate plunger, and an upper plunger. The lower plunger reciprocates within the central bore to meter a variable quantity of fuel and to inject this fuel during downward portions of the reciprocating motion of the plunger assembly. A timing chamber formed between the upper and intermediate plungers is filled with a metered amount of fluid to provide a variable length hydraulic link between the upper and intermediate plungers, and the timing fluid is drained from the chamber through a drain passage during the injection cycle.

The timing chamber has associated with it means for changing the effective flow function of the drain passage, at a point in the cycle following fuel injection, to maintain a large downward pressure on the lower plunger to hold the lower plunger down and thus prevent additional, undesired fuel flow into the combustion chamber. In a preferred embodiment, the drain passage is located axially at the center of the intermediate plunger, and the upper plunger is provided with a projecting portion which moves into position as the timing chamber collapses at the end of the injection cycle to effectively constrict the drain passage, thus changing the timing fluid flow function to a function which results in greater fluid pressure in the timing chamber, and thus greater downward pressure on the lower plunger.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE PREFERRED EMBODIMENTS

A high pressure unit fuel injector having a variable effective spill area according to the present invention is shown generally at 10 in FIGS. 1, 2, and 4*a* through 4*f*. The unit fuel injector 10 may preferably be of the open nozzle type as shown in commonly assigned U.S. Pat. No. 4,721,247 to Perr, incorporated herein by reference, and is part of a fuel injection system wherein each injector is driven by a rotating camshaft via a conventional drive train assembly (not shown), in which a cam is mounted on a rotatable camshaft and a cam follower rides on the cam to cause the injector plunger to reciprocate in synchronism with camshaft rotation.

Figure 1:
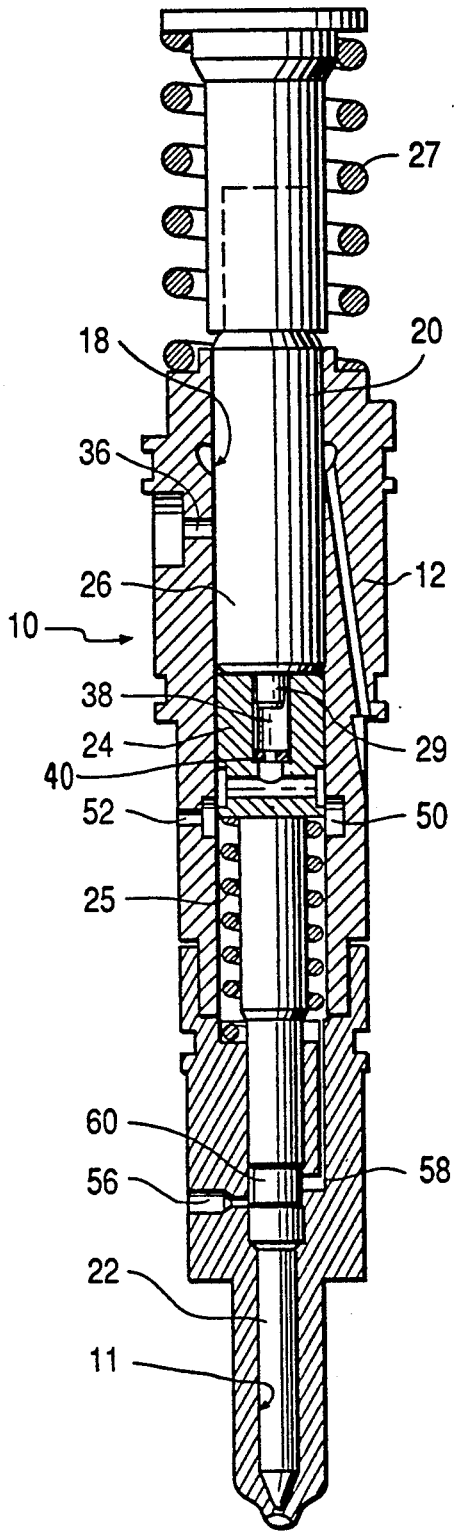
FIG. 1 is a cross-sectional view of a high-pressure unit fuel injector according to one embodiment of the present invention.

Fuel injector 10 of FIG. 1 is adapted to be used in an injection system including one cam driven unit injector per cylinder and a fuel pump which supplies all the injectors by a common rail or supply line. The fuel injection system requires three common fluid rails (not illustrated) within the cylinder head to communicate with each fuel injector. A first rail supplies fuel to each injector for metering into the injection chamber, a second rail drains away uninjected fuel and expelled timing fluid, and a third supplies timing fluid (which may also be fuel) to vary the timing of the injection events. These functions are described in greater detail in U.S. Pat. No. 4,721,247.

The fuel pump and engine throttle operate to supply fuel at a variable rail pressure in the first rail, which controls the quantity of fuel injected. The first rail pressure may be varied in accordance with pressure/time (PT) metering principles as further described in the '247 patent noted above. The amount of injection fuel metered into the injection chamber depends upon both the time that the metering orifice is open, and the pressure of the fuel in the first rail.

By varying the timing fluid pressure in the third rail, the effective length of the plunger is caused to increase and advance the beginning of injection, or to decrease and retard the beginning of injection. The amount of timing fluid introduced into the timing chamber depends only upon the pressure in the third rail. This is accomplished by making the flow passage for the timing fluid large enough that the flow rate of timing fluid is immaterial; that is, the amount of timing fluid introduced is independent of the time that the metering orifice is open. This method of timing pressure control is referred to as pressure (P) control, and the pressure used can be varied in accordance with the principles further described in the '247 patent to obtain a variable effective length of the plunger.

In particular, FIG. 1 shows a fuel injector 10 which is intended to be received within a recess contained in the head of an internal combustion engine (not shown). A variable quantity of fuel is metered into an injection chamber 11 (shown collapsed), and injector 10 injects this fuel into the combustion chamber of the engine. The body or housing of the injector comprises an injector barrel 12. Extending axially through the fuel injector is a bore 18 within which a reciprocating plunger assembly 20 is disposed for injecting fuel into the combustion chamber of the internal combustion engine.

Reciprocating plunger assembly 20 includes three plungers. An injection or lower plunger 22 is the lowermost plunger and injects fuel into the combustion chamber of an engine as discussed below. Serially arranged above lower plunger 22 are an intermediate plunger 24 and an upper plunger 26. A return spring 27 engages the upper end of upper plunger 26 at one end and seats against the top of the injector barrel 12, thus biasing the upper plunger 26 to return it to an uppermost position within bore 18 when upper plunger 26 is not forced downward by the injection cam which acts thereon via the drive train assembly. A bias spring 25 biases intermediate plunger 24 upwardly to provide an upward bias against which the timing fluid must operate to set the desired timing advance as described in greater detail below. In this embodiment, intermediate plunger 24 is integral with lower plunger 22, whereby bias spring 25 is effective to move lower plunger 22 upwardly when permitted by the upward movement of upper plunger 26. Upper plunger 26 has an axial projection 29 on its lower surface which, when the plungers are collapsed as shown in FIG. 1, enters a timing chamber drain passage 38 located centrally and axially in intermediate plunger 24. The vertical dimension of timing chamber drain passage 38 is more than the length of axial projection 29, so that axial projection 29 will not contact intermediate plunger 24.

As noted above, intermediate plunger 24 and lower plunger 22 are integrally connected to move together in the bore 18. However, if desired, intermediate plunger 24 and lower plunger 22 could be designed as relatively movable parts and a bias spring and valve could be provided to bias the plungers upwardly as disclosed in commonly assigned U.S. Pat. No. 4,986,472, incorporated herein by reference.

As noted above, the amount of fuel metered for injection in injection chamber 11 is regulated according to pressure/time principles (PT metering). A fuel supply passage 56 is provided for connection to the aforementioned first rail. The fuel supply passage 56 has known hydraulic characteristics in order to produce the desired pressure/time metering capability.

When injection has ended by lower plunger 22 seating in the nozzle tip, fuel passage from fuel supply passage 56 to an axially relieved portion 60 of lower plunger 22 and travels upwardly in a known manner through a scavenge flow drain passage 58 into a compensating chamber (not shown in detail) and then out of injector housing 16 and into the second aforementioned rail.

Figure 2:
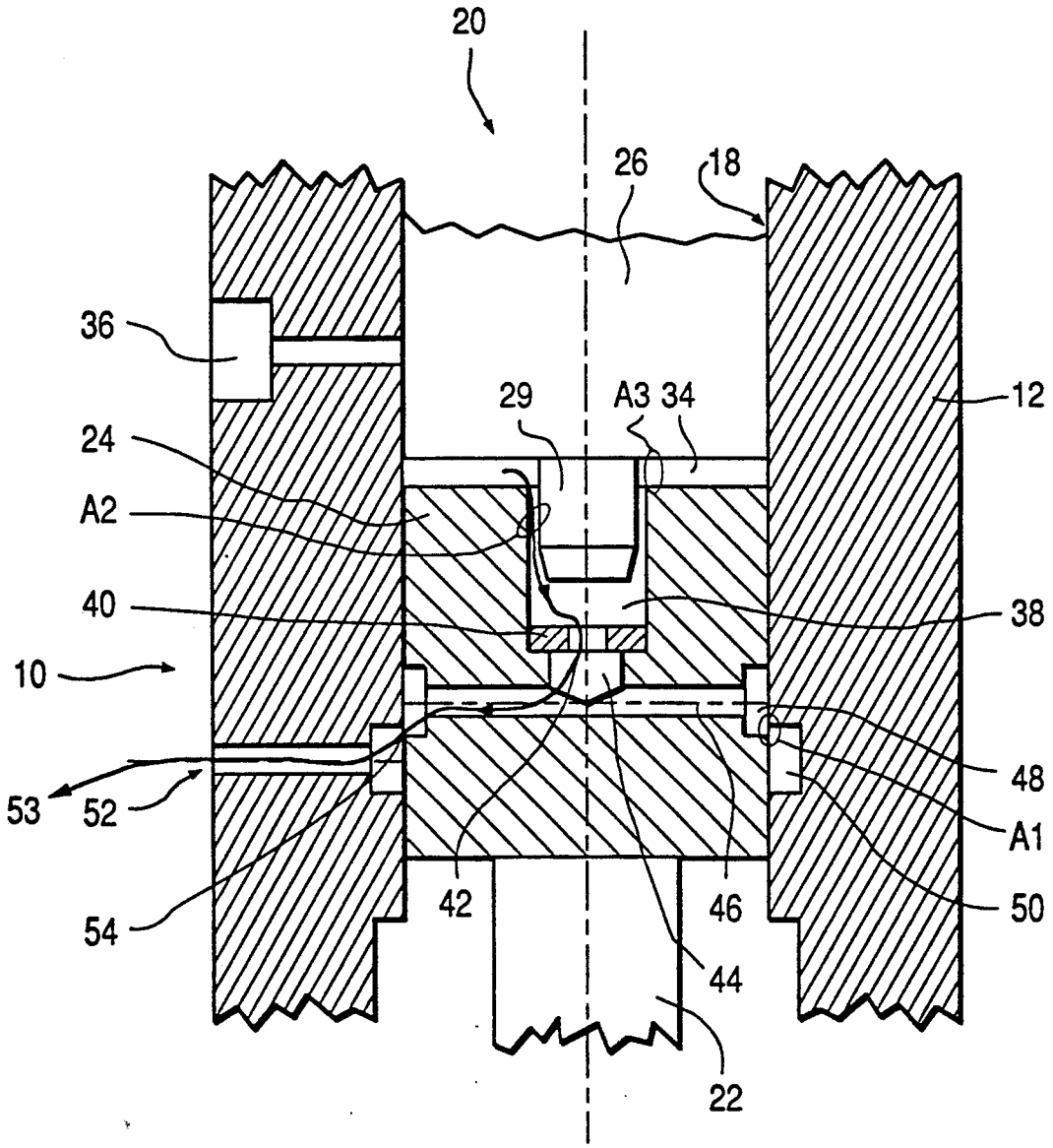
FIG. 2 is an enlarged cross-sectional view of the plunger assembly of the injector of FIG. 1.

Referring now to FIG. 2, the central portion of the injector 10 of FIG. 1 is shown in enlarged cross-section. Between upper plunger 26 and intermediate plunger 24 a collapsible timing chamber 34 is formed. Timing chamber 34 receives hydraulic timing fluid, such as fuel, from a timing fluid passageway 36 formed through the barrel 12 of the injector housing. Timing fluid passageway 36 is located to be opened by upper plunger 26 only when upper plunger 26 is moved sufficiently upwardly by return spring 27 and the corresponding cam (not shown). The timing fluid, which enters timing chamber 34 and then becomes trapped therein during the downward stroke of upper plunger 26, forms a variable-length hydraulic link between intermediate plunger 24 and upper plunger 26, thus effecting variable control of the timing of fuel injection, and is discharged from timing chamber 34 under certain conditions at the end of the injection cycle which will be explained in detail later.

When appropriate, the timing fluid in timing chamber 34 is discharged through timing chamber drain passage 38 which is preferably formed centrally and axially through intermediate plunger 24. Disposed in timing chamber drain passage 38 is a flow constricting insert 40 in the form of a disc with a center hole, central control orifice 42. Central control orifice 42 has a smaller diameter than the diameter of timing chamber drain passage 38, and this diameter is chosen to provide a specified reduced flow rate so as to generate a fluid backpressure in timing chamber 34 to resist the collapse of timing chamber 34 during draining of the timing fluid. Below central control orifice 42 is an axial passage 44 which connects the passage of central control orifice 42 to a diametric drain passage 46 having a central longitudinal axis along a diameter of intermediate plunger 24, intersecting axial passage 44 at a right angle. Diametric drain passage 46 communicates with an annular groove 48 formed in the outer surface of intermediate plunger 24 to facilitate timing fluid flow.

Injector barrel 12 is provided with an internal circumferential groove 50 connected to one or more spillports 52. Groove 50 is positioned to meet with annular groove 48 at a circumferential overlap space 54 during downward movement of intermediate plunger 24. Thus, as intermediate plunger 24 moves downward during the injection cycle, annular groove 48 moves proximate to groove 50, providing a fluid passage 53 from timing chamber 34 through central control orifice 42, axial passage 44, diametric drain passage 46, annular groove 48, overlap space 54, groove 50, and spillport 52. The annular groove 48 meeting with diametric drain passage 46 is preferably cut larger than the diametric drain passage 46 to reduce fluid backpressure in the area of overlap space 54. Similarly, groove 50 preferably has a greater diameter than does spillport 52.

The area of overlap space 54 is designated by A1. The cross-sectional area connecting timing chamber 34 to timing chamber drain passage 38 is designated by A2, and A3 designates the surface area of a cylinder having the diameter of passage 38 and extending between the upper surface of intermediate plunger 24 and the lower surface of upper plunger 26.

Fluid passage 53 facilitates draining of the timing fluid and thus the collapse of timing chamber 34. The timing of this draining action during the injection cycle is thus determined in part by the positioning of groove 50 and diametric drain passage 46 (including annular groove 48), since the coincidence of their locations forms overlap space 54 to complete the fluid passage.

Preferably, groove 50 and diametric drain passage 46 will be positioned so that fluid passage 53 is established when lower plunger 22 has reached its lowest position, i.e. when the fuel from injection chamber 11 has been injected into the engine combustion chamber. The ultimate size of overlap space 54 is determined by the positioning of spillport 52 relative to the position taken by diametric drain passage 46 when lower plunger 22 is fully seated and the metered fuel has been fully injected into the combustion chamber. Preferably, the maximum vertical height of overlap space 54 when lower plunger 22 is fully seated is between 0.05 and 0.08 mm.

Upon completion of fuel injection and establishment of fluid passage 53, fluid will begin to drain from timing chamber 34, permitting collapse of timing chamber 34 so that the hydraulic link between upper plunger 26 and lower plunger 22 is decoupled and upper plunger 26 may continue its downward travel without further downward movement of lower plunger 22. During drainage of the timing fluid from timing chamber 34, the continuing downward force on upper plunger 26 is transmitted through the timing fluid to create a downward force on intermediate plunger 24. The force transmitted through the timing fluid tends to hold intermediate plunger 24 (and thus lower plunger 22) in their lowermost positions, thereby preventing undesired secondary injection of fuel from the injection chamber 11 into the combustion chamber. Significantly, this fluid pressure force on lower plunger 22 during the later stages of timing chamber collapse is greatly increased by the provision of axial projection 29 on upper plunger 26.

Axial projection 29 is effectively a multistage drain force varying means which operates to change the mathematical function describing the speed of fluid flow through timing chamber drain passage 38, at a point in the cycle following fuel injection into the combustion chamber, to maintain a large downward pressure on lower plunger 22, holding lower plunger 22 down and thus preventing additional, undesired fuel flow into the combustion chamber. Specifically, axial projection 29 moves into position as timing chamber 34 collapses to effectively constrict drain passage 38 of fluid passage 53, thus changing the timing fluid flow function through fluid passage 53 discontinuously to a function which results in greater fluid pressure in timing chamber 34, and thus greater downward pressure on lower plunger 22 during this portion of the injection cycle. The change in fluid flow function produced by the movement of axial projection 29 can also be described as a change in the fluid pressure function of the timing chamber, and results in a corresponding discontinuous redefinition of the force function describing the holddown force on lower plunger 22. The configuration of axial projection 29 makes it more difficult for the timing fluid to escape through fluid passage 53. The resulting increased fluid pressure tends to transmit the downward cam force on upper plunger 26 to more firmly seat lower plunger 22, preventing secondary injection of fuel into the combustion chamber.

Of course, depending on the shape of axial projection 29, the force function can also be redefined in a substantially continuous manner. For example, an axial projection 29 shaped in the form of an apex of a cone will provide a very nearly continuous change in the fluid flow function as it begins to interact with the fluid passage 53.

Thus, the interaction of axial projection 29 with drain passage 38 provides a variable area timing fluid spill passage, with a large spill area at the start of the spill when the operating cam is moving at high velocity. Later, when axial projection 29 interacts with the walls of drain passage 38 to change the drainage function and thus reduce the effective area of drain passage 38, the resulting increased backpressure on the timing fluid results in increased force transmission to lower plunger 22 and thus maintenance of a constant blowdown load. The relative increase in the downward force on the lower plunger provided by injector 10 prevents upward movement of lower plunger 22 which would result in secondary injection.

As shown in FIG. 2, axial projection 29 is preferably shaped as a solid cylinder, with the lowermost end beveled about its circumference to form a surface corresponding to a portion of the frustrum of a cone having its apex at a point below the axial projection 29. The cylindrical portion of axial projection 29 preferably has a diameter slightly less than the diameter of timing chamber drain passage 38, so that fluid may pass from timing chamber 34 through timing chamber drain passage 38 when axial projection 29 has entered timing chamber drain passage 38.

Figure 3A:
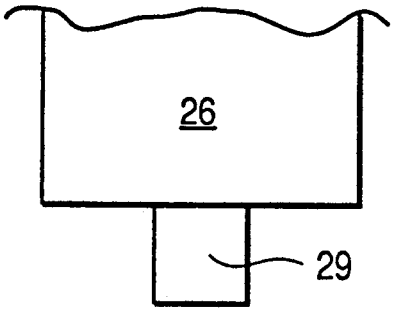
FIGS. 3*a* through 3*d* show preferred configurations of the projection on the upper plunger according to the present invention.
Figure 3B:
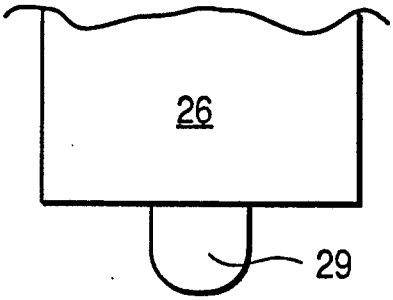
Figure 3C:
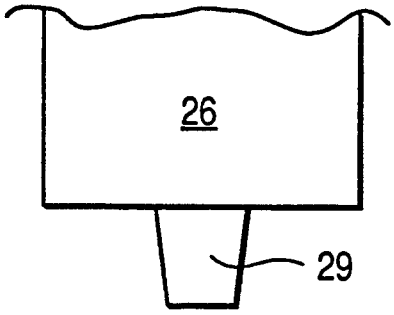
Figure 3D:
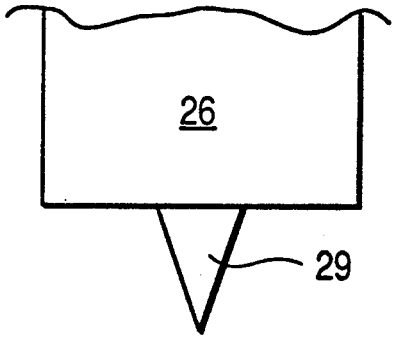

Of course, as illustrated with reference to FIGS. 3*a* through 3*d*, other appropriate shapes could be used to axial projection 29, depending on the desired timing fluid flow function. For example., axial projection 29 could be formed as a cylinder with no shaping of the lowermost end, as shown in FIG. 3*a*. This structure would produce a sharper increase in fluid backpressure upon engagement with timing chamber drain passage 38. Axial projection 29 could also be formed with a rounded, e.g. hemispherical lower end, as shown in FIG. 3*b*; as a portion of the frustrum of a cone, as shown in FIG. 3*c*; as a conical portion including the apex of a cone as illustrated in FIG. 3*d*, or in any other desired shape to produce a desired timing fluid flow function.

Figure 4A:
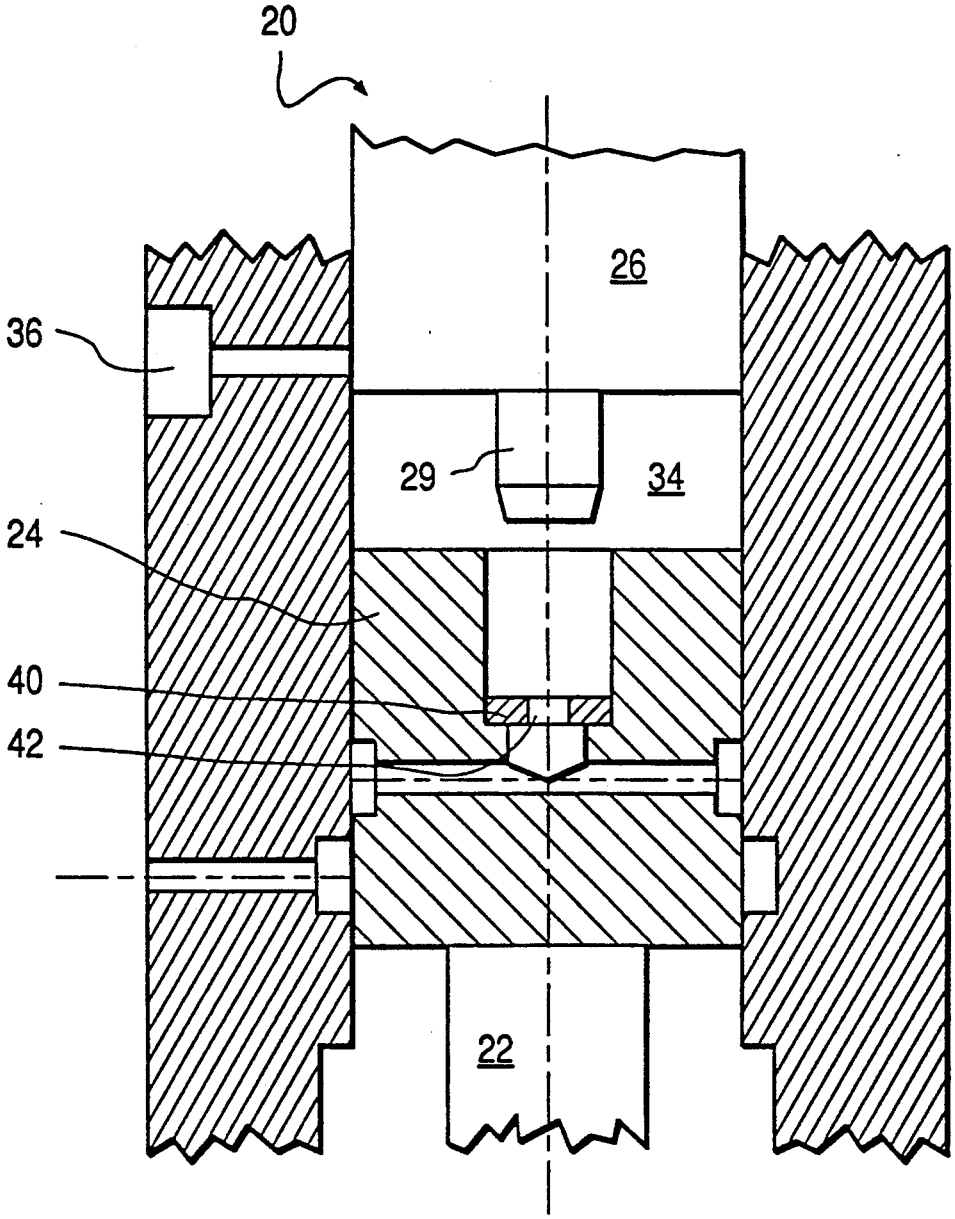
FIGS. 4*a* through 4*f* are cross-sectional views of the central portion of the injector of FIG. 1 in the different phases of its operation.

FIGS. 4*a* through 4*f* show this operation of the injector of FIGS. 1 and 2 at each stage during a typical injection cycle. Stage 1, injection, is shown in FIG. 4*a*. During this stage, timing fluid has been placed in timing chamber 34 through timing fluid passageway 36 during an upward stroke of the injector. When the bottom of upper plunger 26 moves below timing fluid passageway 36, timing fluid passageway 36 is sealed off and timing chamber 34, filled with timing fluid, becomes a hydraulic link between upper plunger 26 and intermediate plunger 24. Thus, intermediate plunger 24 and lower plunger 22 move downward in concert with both the cam-driven upper plunger 26 and timing chamber 34. The timing of the timing chamber fill and the establishment of the hydraulic link, and thus the timing of fuel injection into the combustion chamber, are controlled in accordance with known principles of fuel injector timing operation, such as disclosed in the previously mentioned patent to Perr and also commonly assigned U.S. Pat. No. 4,986,472 to Warlick et al., which are incorporated herein by reference. Thus, during this first, injection stage, the plunger assembly 20 is forced downward as a unit to inject a previously metered amount of fuel into the engine combustion chamber, and a metered amount of timing fluid remains trapped in timing chamber 34. Axial projection 29 does not affect the downward pressure on lower plunger 22 during this stage of the injection cycle.

Figure 4B:
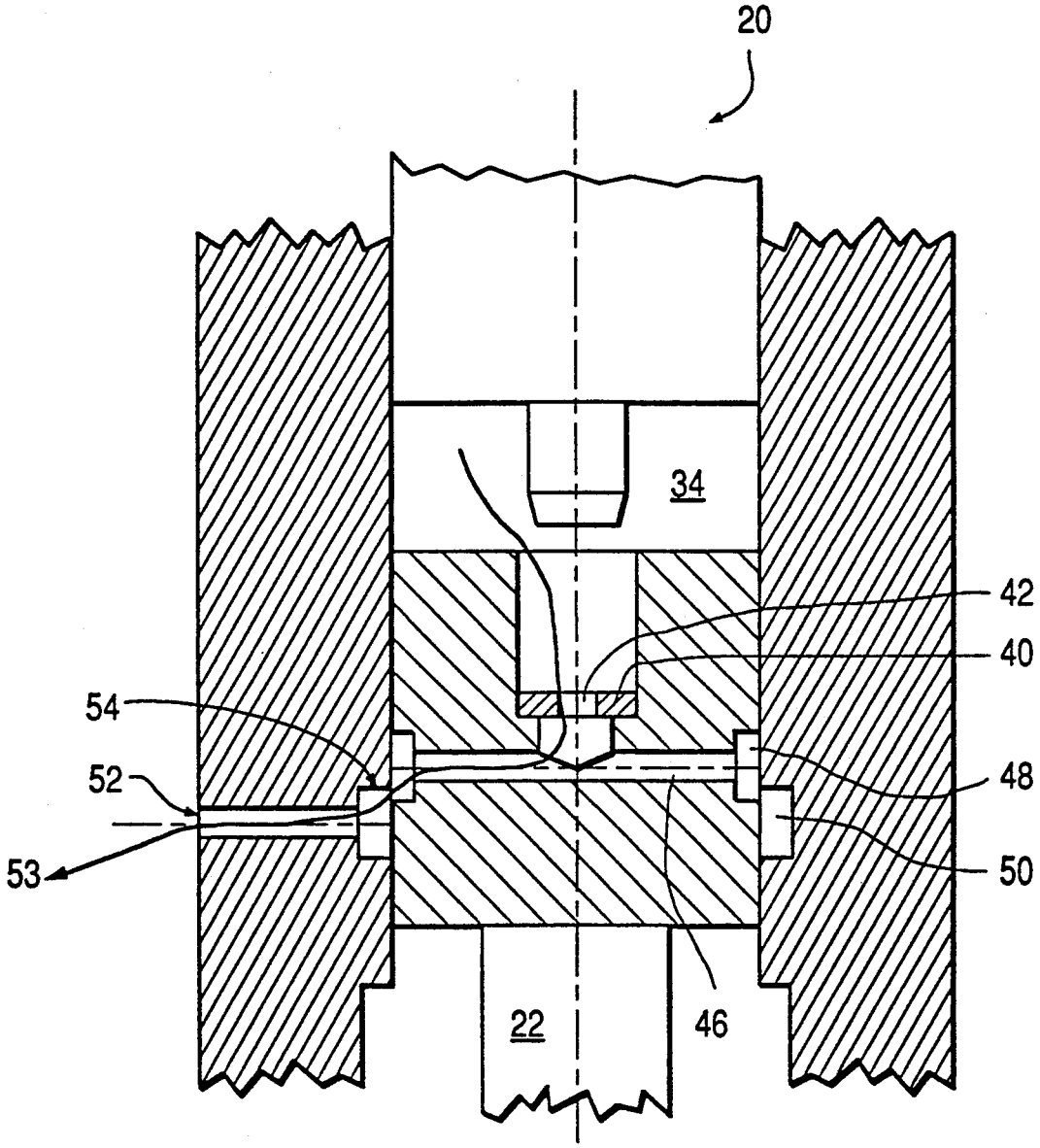
Figure 4C:
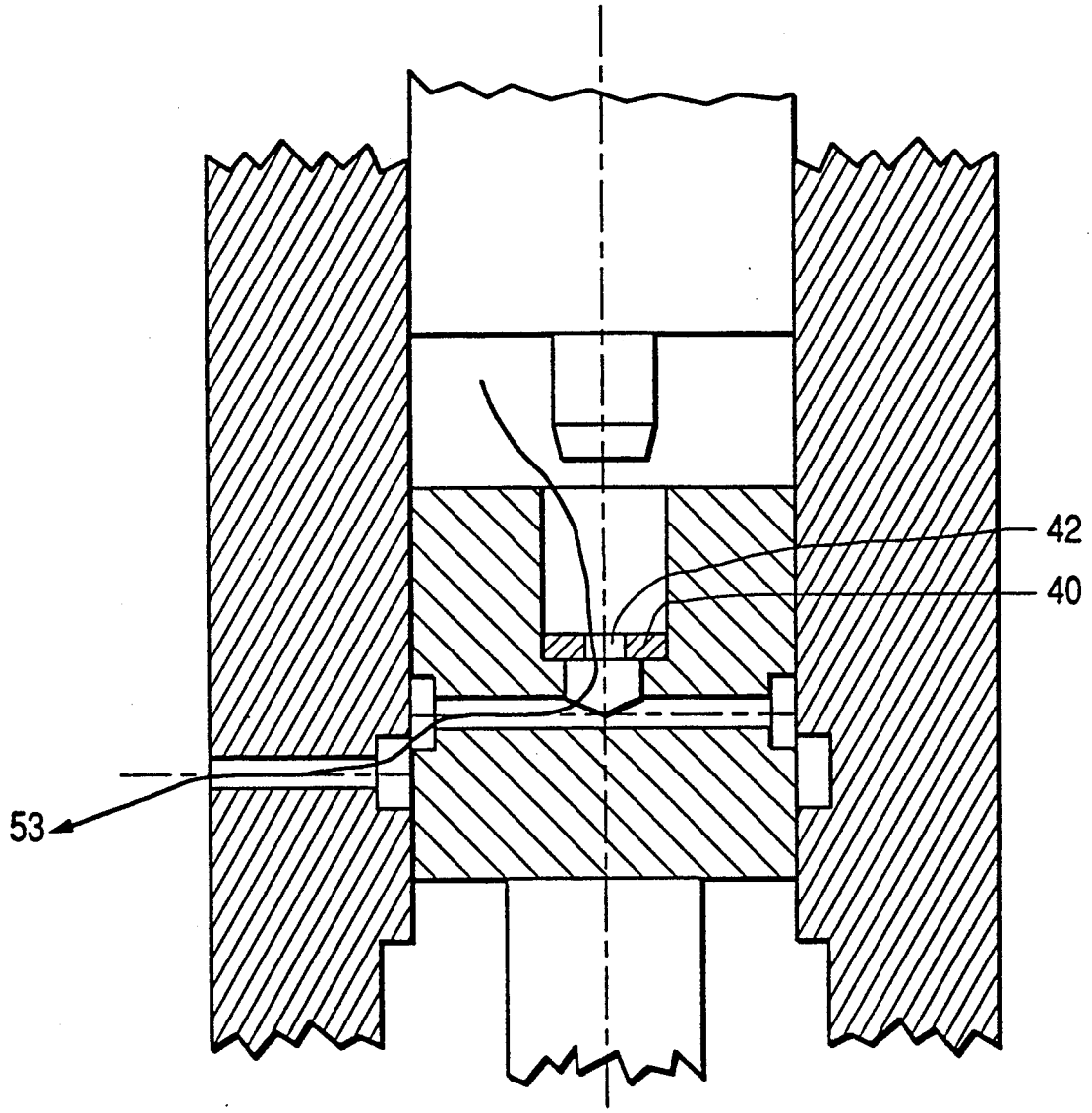

The plunger assembly 20 continues to move downward to reach the position shown in FIG. 4*b*, representing Stage 2 of the injection cycle, which is the opening of the spillport. The annular groove 48 of diametric drain passage 46 meets groove 50 at overlap space 54, thus completing fluid passage 53 which permits the flow of timing fluid from timing chamber 34 out through spillport 52. During stage 2, the size of overlap space 54 increases as the lower plunger 22 moves toward its bottommost, fully seated position. When overlap space 54 has reached its maximum size, Stage 3 begins, as shown in FIG. 4*c*.

During Stage 3, as the timing fluid drains through fluid passage 53, timing chamber 34 begins to collapse, and upper plunger 26 bearing axial projection 29 moves closer to intermediate plunger 24, which remains in a fixed position, held down against lower plunger 22 by the pressure transmitted through the timing fluid in fluid chamber 34.

Figure 4D:
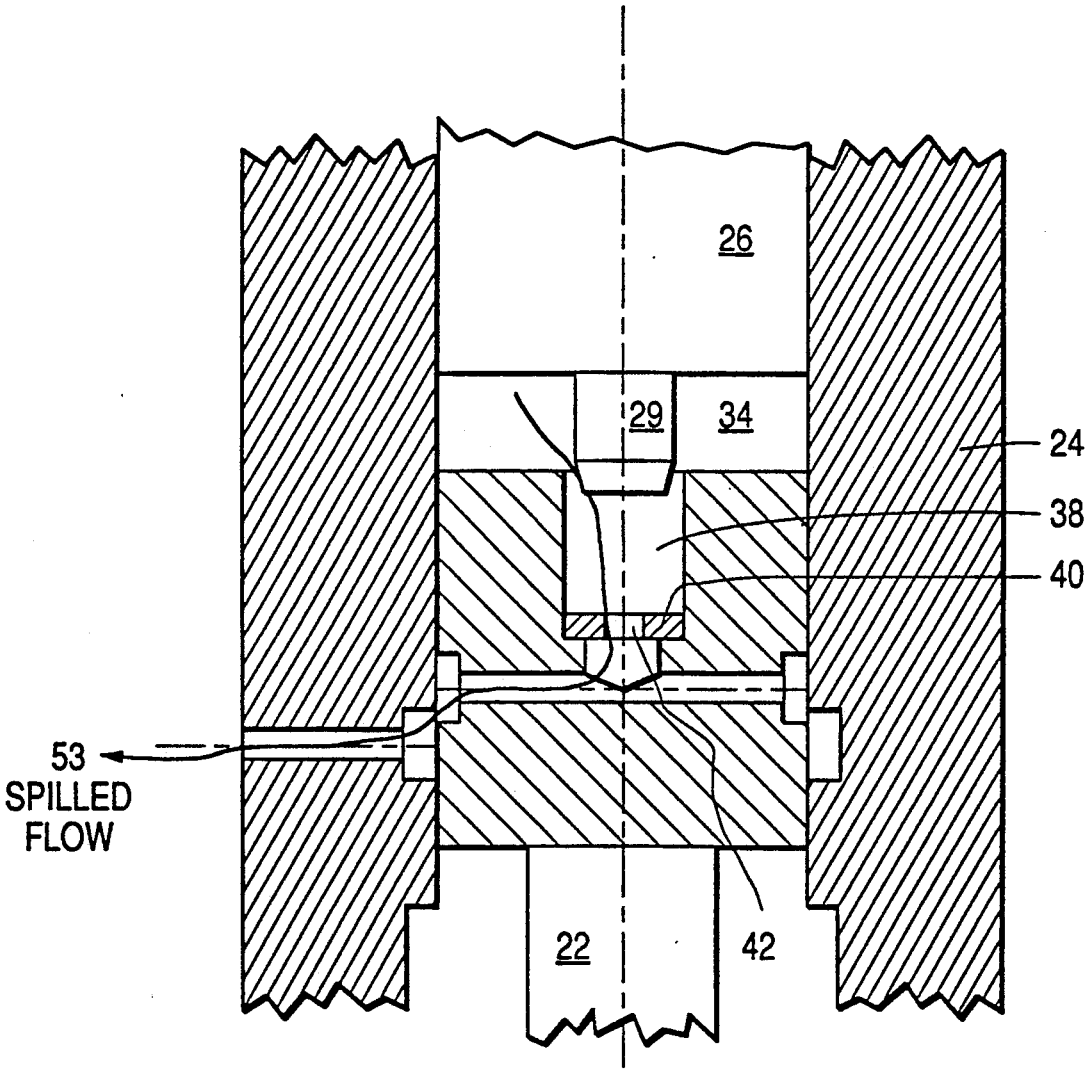
Figure 4E:
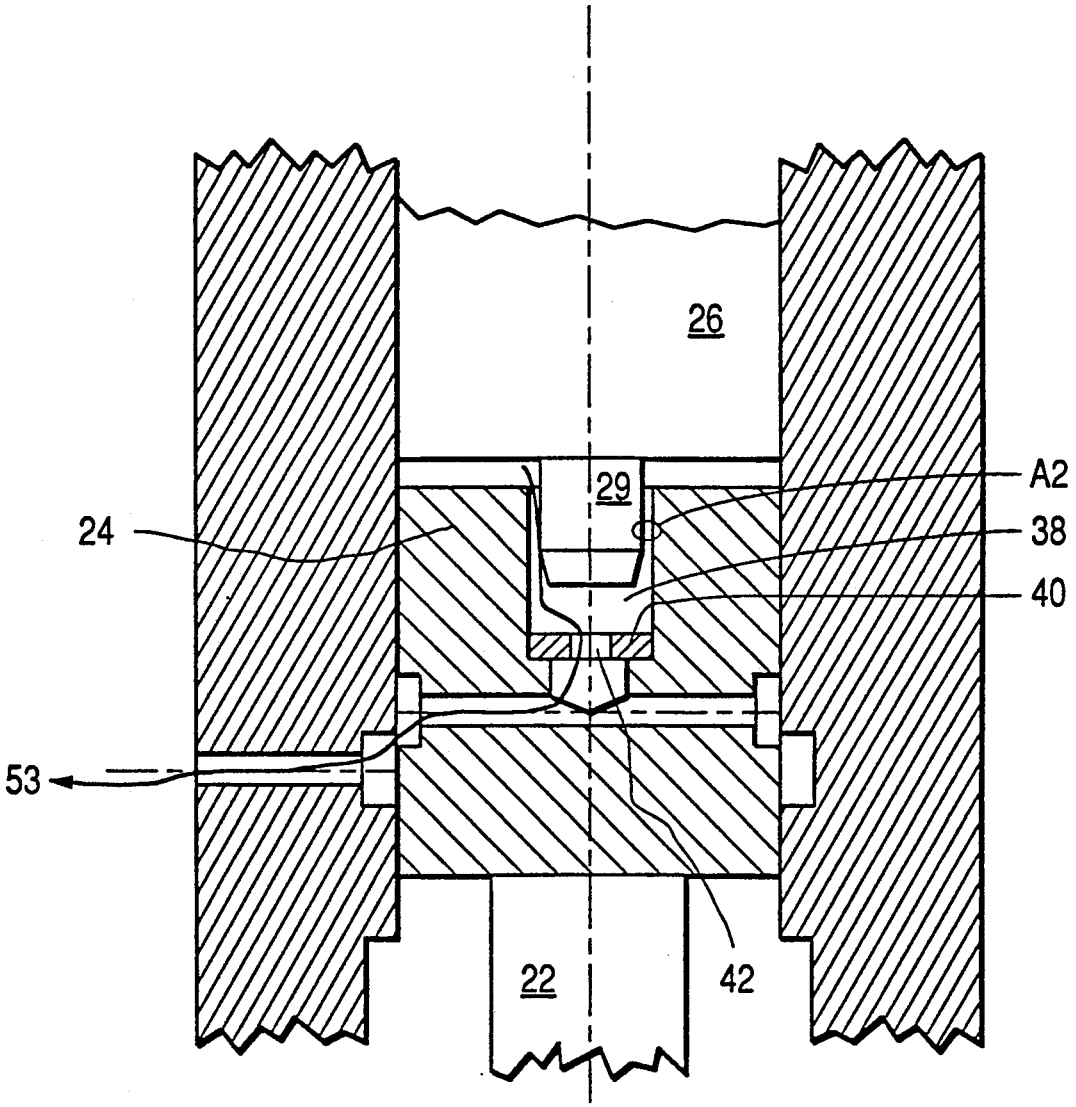
Figure 4F:
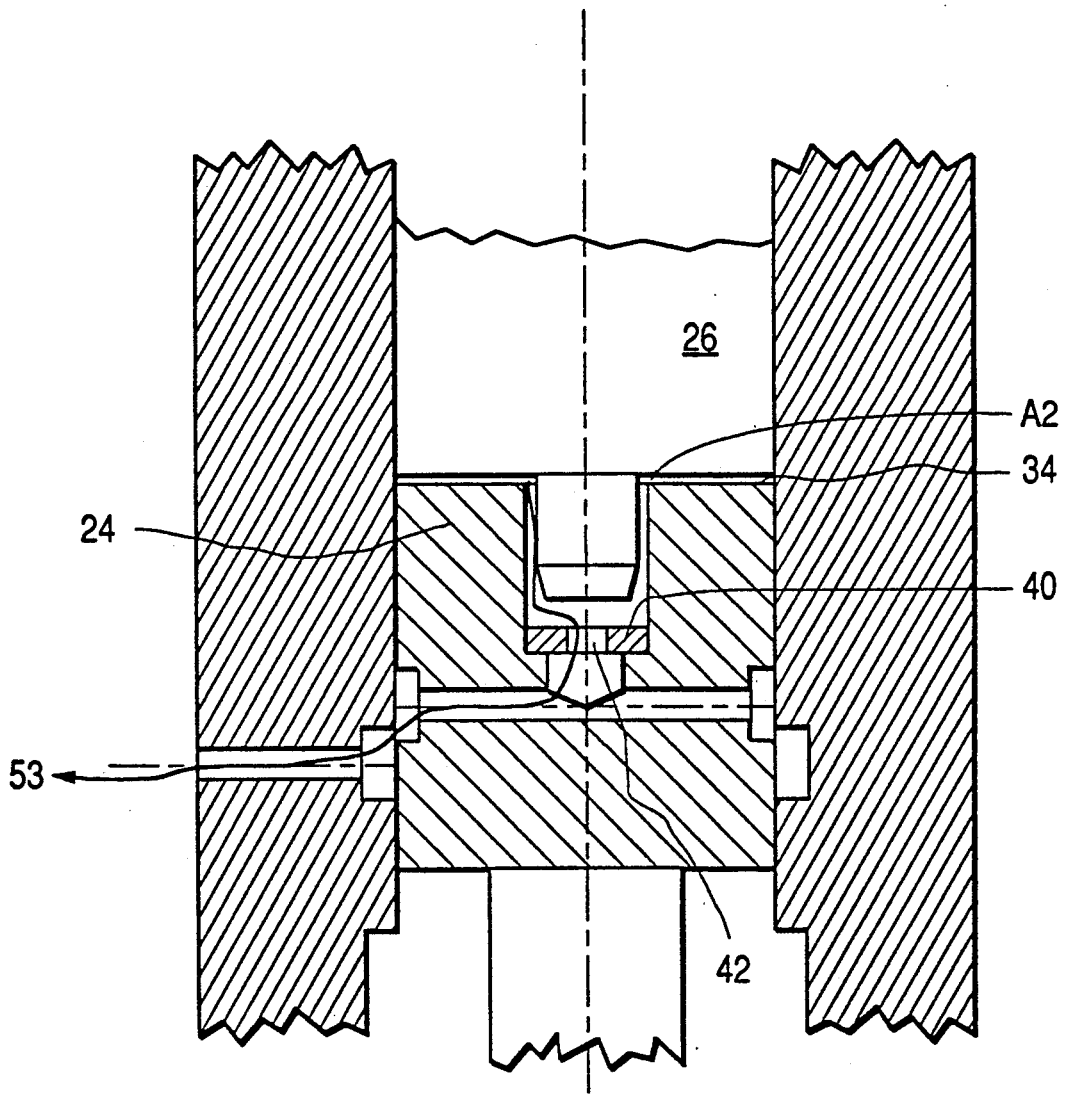

Stage 4 occurs when axial projection 29 moves downward to approach timing chamber drain passage 38, as shown in FIG. 4*d*. As axial projection 29 moves closer to the top portion of timing chamber drain passage 38, a throttling action will occur as the fluid flow area from timing chamber 34 to timing chamber drain passage 38 is constricted by the presence of axial projection 29. The timing of the initiation of Stage 4 can be controlled by varying the length of axial projection 29. Stage 5 (shown in FIG. 4*e*) begins when the cylindrical portion of axial projection 29 actually enters timing chamber drain passage 38. The entry of axial projection 29 into timing chamber drain passage 38 further constricts flow area A2, increased the fluid pressure in timing chamber 34.

During Stage 5, upper plunger 26 continues to move downward toward intermediate plunger 24 as timing chamber 34 collapses. The process is completed at Stage 6, final throttling, shown in FIG. 4*f*. In Stage 6, upper plunger 26 comes so close to intermediate plunger 24 that area A3 (defined as the cylindrical surface area, having the diameter of passage 38, between the upper and intermediate plungers) becomes smaller than A2 and thus is the final controlling area throttling expulsion of fuel from the timing chamber.

As can be seen with reference to FIGS. 4*a* through 4*f*, the diameter of central control orifice 42 of flow constricting insert 40 determines the volume of spill flow during the first, high-cam-speed portion of the injection cycle. A relatively large central control orifice 42 can be used to reduce spill load.

Figure 5:
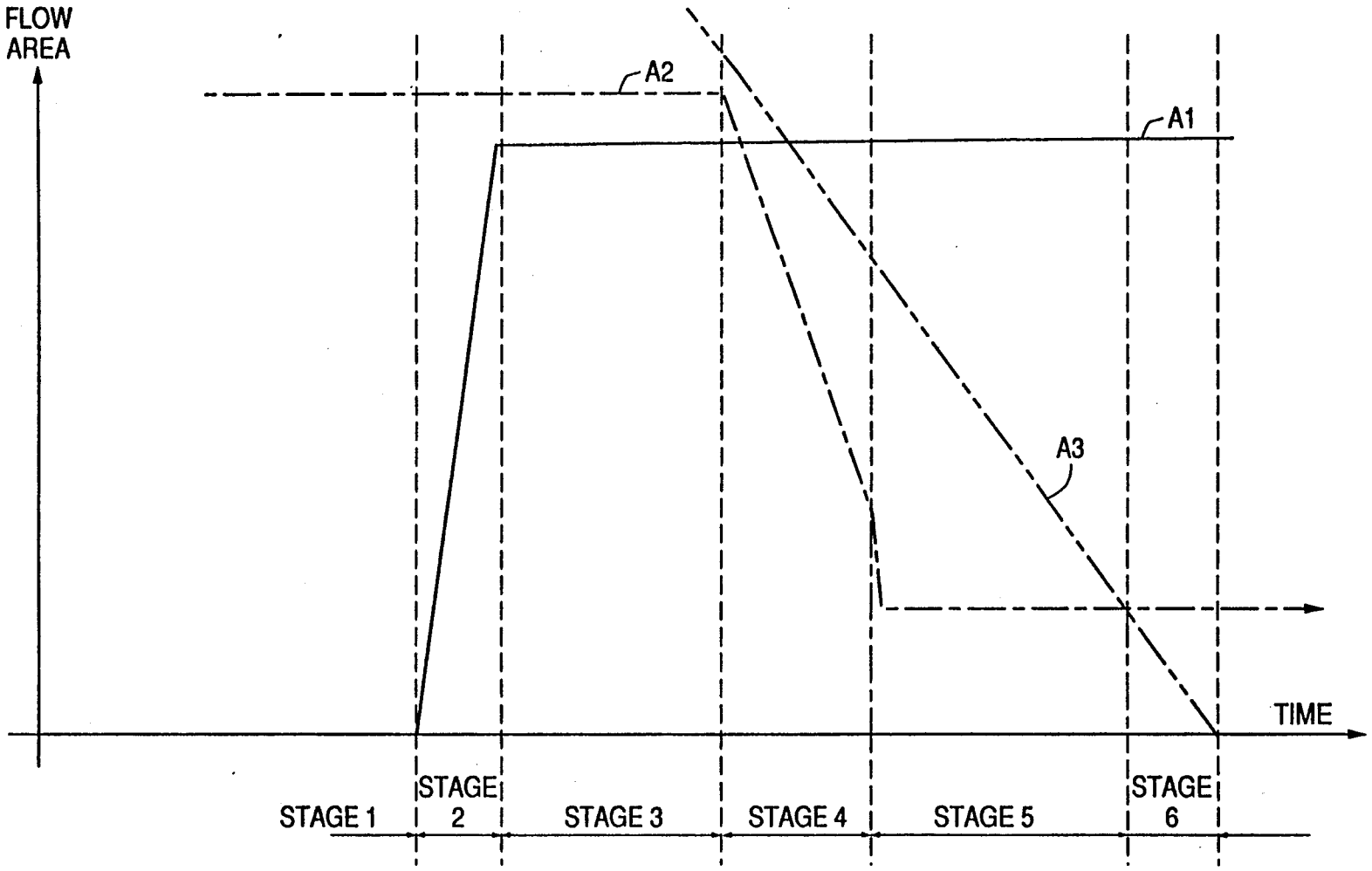
FIG. 5 is a timing diagram showing flow areas within the injector of the present invention in the portions of the injection cycle illustrated in FIGS. 4*a* through 4*f*.

FIG. 5 is a timing diagram showing the areas A1, A2, and A3 at each stage of the injection cycle (illustrated in FIGS. 4*a* through 4*f*). As shown in FIG. 5, during Stage 1, the area A1 of the overlap space 54 is zero since spillport 52 is closed. During Stage 2, A1 increases steadily to reach a maximum constant value at the beginning of Stage 3. This value of A1 continues through the end of the cycle. A2, the effective flow area from timing chamber 34 to timing chamber drain passage 38, begins the cycle with a constant value equal to the diameter of timing chamber drain passage 38. In Stage 4, area A2 is reduced as axial projection 29 begins to engage timing chamber drain passage 38. In Stage 5, area A2 levels off at a reduced, constant value, as axial projection 29 fully engages timing chamber drain passage 38. A2 maintains this new constant value until the end of the injection cycle. Area A3, the cylindrical surface area defined above, decreases at the constant rate of decrease in the distance separating the upper and intermediate plungers until A3 reaches zero.

Thus, during the first, high-cam speed portion of the injector blowdown (Stages 1 through 3), A2 is large, providing a low spill load opposing the cam force. This construction thus reduces the power used by the injection system, which is drawn from the engine (referred to as a parasitic load). The present invention also provides reduced impact and blowdown loads, particularly at high engine speeds.

Another significant advantage of this design is that both the load and the spill flow during the cycle are controlled by area A2 and the diameter of central control orifice 42. These are not areas of contact between relatively moving parts of the injector 10, like overlap space 54, so they are not subject to wear. Because these areas are not subject to contact wear, the load and spill flow of injector 10 are not wear sensitive, and performance will stay relatively constant even after extended use.

Figure 6:
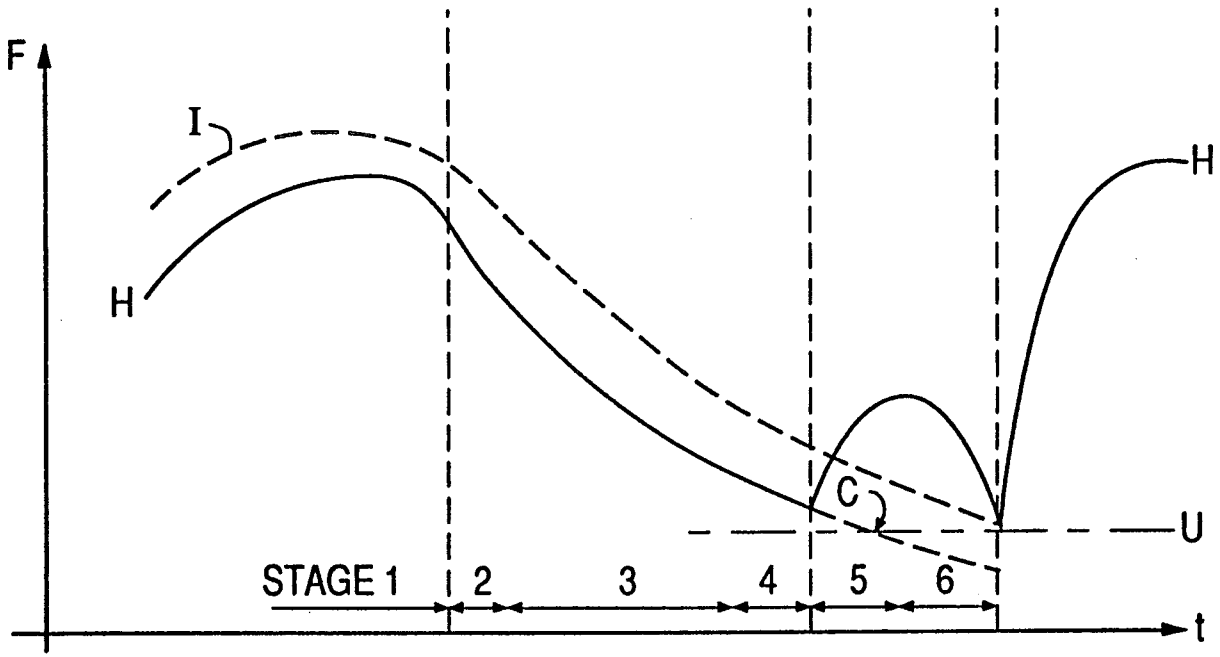
FIGS. 6 is a graph of the holddown force on the lower plunger of the injector, showing a discontinuous redefinition of the force function resulting from the design of the present injector.

FIG. 6 is a graph showing the holddown force H on lower plunger 22 in injector 10 according to the present invention. As can be seen, the holddown force H at each of Stages 1–6 of the injection cycle exceeds an upward force U opposing the seating of lower plunger 22. In Stages 5 and 6, the operation of axial projection 29 as described previously herein modifies the fluid flow function in timing chamber 34 to produce the increased force and discontinuity shown in FIG. 6. The increased holddown force H transmitted by means of the increased fluid backpressure in timing chamber 34 ensures that force H remains above opposing force U throughout the relevant portion of the injection cycle, thus preventing unseating of the lower plunger 22 which would result in undesired secondary injection.

In contrast, the holddown force function of a similar injector without a means for changing the mathematical force function during the injection cycle is shown at C. As the timing chamber 34 of such an injector collapses, the holddown force drops off according to a continuous function as shown. At some point, particularly in Stage 5 or 6 as shown, the holddown force may be insufficient to oppose an upward force U, so that lower plunger 22 will become unseated. The only solution to this problem (in the absence of means for varying the fluid flow function during the injection cycle according to the present invention) is to generally increase the downward force by increasing an operating parameter, such as cam force, to produce an upwardly shifted, increased force curve I which maintains the force above force U. Curve I represents an increased blowdown load, increased impact load, and increased parasitic operating losses for the engine. Thus, those skilled in the art will readily appreciate that the injector 10 having a fluid flow function which can be varied during the injection cycle as disclosed herein provides a significant advantage in elimination of secondary injection, while at the same time enabling low parasitic power losses, and reduced impact and blowdown loads.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

INDUSTRIAL APPLICABILITY

The high pressure unit fuel injector of the present invention finds application in a large variety of internal combustion engines. One particularly important application is for small compression ignition engines adopted for automotive uses such as powering automobiles. Lighter truck engines and medium range horsepower engines also could benefit from the use of fuel injectors according to the present invention.

We claim:

1. A fuel injector of a type driven by a cam to operate in an injector cycle which includes an initial high cam speed portion and a subsequent lower cam speed portion at the end of the cycle to periodically inject fuel into the combustion chamber of an internal combustion engine during successive injector cycles, comprising:

a) an injector body having a central bore and an injection orifice communicating between said central bore and the combustion chamber;

b) upper and lower plungers mounted for reciprocating movement within said central bore between retracted and advanced positions during each injector cycle;

c) hydraulic timing means for varying the timing of fuel injection during successive injector cycles, said hydraulic timing means including:

i) a variable volume timing chamber formed between said upper plunger and said lower plunger;

ii) timing fluid supply means for supplying timing fluid to said timing chamber to control the volume of said timing chamber during successive injector cycles;

d) blowdown force generating means for creating a blowdown force on said lower plunger tending to hold said lower plunger in its advanced position following termination of fuel injection during each injection cycle, said blowdown force generating means including:

(i) a drain passage through which timing fluid is expelled from said timing chamber following termination of fuel injection during each injector cycle, and (ii) multistage drain force varying means including a flow constricting portion with a central control orifice in said drain passage, and a projecting surface moving with at least one of said plungers and interacting with said drain passage for varying a backpressure of said timing chamber fluid according to a first function during a first period following the injection portion of the injector cycle, and according to a second, different function during a subsequent period following the injection portion of the injector cycle, the diameter of said central control orifice determining the flow of said timing fluid from said timing chamber during said high cam speed portion of the cycle, and the first and second functions determining the flow of said timing fluid from said timing chamber during said low cam speed portion of the cycle.

2. The injector of claim 1 wherein said projecting surface is located on said upper plunger and said drain passage is located on said lower plunger.

3. The injector of claim 1 further comprising an intermediate plunger between said upper plunger and said lower plunger, said drain passage located in said intermediate plunger and said projecting surface extending from a lower surface of said upper plunger.

4. The injector of claim 3 wherein said drain passage is located centrally axially in said intermediate plunger.

5. The injector of claim 1 wherein said projecting surface has a substantially cylindrical shape.

6. The injector of claim 5 wherein said cylindrical projecting surface has a beveled lowermost edge.

7. The injector of claim 5 wherein said cylindrical projecting surface has a rounded lowermost edge.

8. The injector of claim 1 wherein said projecting surface has a substantially conical shape.

9. The injector of claim 8 wherein said conical projecting surface is a portion of the frustrum of a cone.

10. The injector of claim 8 wherein said conical projecting surface is a portion of a cone including the apex of said cone.

11. The injector of claim 1 wherein said projecting surface has a substantially hemispherical shape.

12. The injector of claim 1 wherein the lower plunger is biased upwardly by a spring producing a bias force.

13. The injector of claim 12 wherein timing fluid is metered into said timing chamber when said upper plunger is adjacent its retracted position.

14. The injector of claim 13 wherein the amount of timing fluid metered into said timing chamber is determined by the pressure of the supplied timing fluid.

15. The injector of claim 14 wherein the entry of timing fluid into said timing chamber under said pressure of the timing fluid is opposed by said bias force of said spring.

16. The injector of claim 14 wherein a flow passage carrying said timing fluid to said timing chamber is made large enough such that the length of a hydraulic link formed between said upper and lower plungers by said timing fluid is independent of the time during which said timing fluid is introduced to said timing chamber.

17. The injector of claim 1 wherein injection fuel injected into said combustion chamber during said injector cycle is metered into an injection chamber formed in said central bore through an orifice communicating with a fuel source when said lower plunger is adjacent its retracted position.

18. The injector of claim 17 wherein the amount of said injector fuel so metered depends both upon the time that said orifice is open and upon a pressure of said fuel source.

19. A high pressure fuel injector of a type driven by a cam to operate in an injector cycle which includes an initial high cam speed portion and a subsequent lower cam speed portion at the end of the cycle, for injecting fuel into the combustion chamber of an internal combustion engine during an injection portion of the injector cycle, comprising:

an injector body having a central bore and an injection orifice communicating between said central bore and the combustion chamber;

upper and lower plungers mounted for reciprocating movement within said central bore between retracted and advanced positions;

hydraulic timing means for varying the timing of the injection of metered fuel, said hydraulic timing means including a timing chamber formed below said upper plunger and above said lower plunger, the timing chamber being filled with fluid and subsequently collapsible following the injection portion of the injector cycle by escape of fluid from the timing chamber, said hydraulic timing means including a fluid exit means including a flow constricting portion with a central control orifice having an effective area determined by the diameter of said central control orifice for throttling the escape of fluid from the timing chamber during said high cam speed portion of the cycle to create a blowdown pressure in the timing chamber tending to bias said lower plunger toward its advance position; and varying means interactive with the fluid exit means for reducing the effective area of the fluid exit means to below that of said central control orifice at a specified time during the collapse of the timing chamber at the end of said injection cycle corresponding to said lower cam speed portion of said cycle, to maintain the blowdown pressure at a sufficiently high level to maintain said lower plunger in its advanced position.

20. The injector of claim 19 wherein said varying means comprises a projection moving with a plunger to reduce the effective area of the fluid exit means.

21. The injector of claim 20 wherein said projection is located on said upper plunger and said drain passage is located in said lower plunger.

22. The injector of claim 20 further comprising an intermediate plunger between said upper plunger and said lower plunger, said drain passage located in said intermediate plunger and said projection extending from a lower surface of said upper plunger.

23. The injector of claim 22 wherein said drain passage is located centrally axially in said intermediate plunger.

24. The injector of claim 20 wherein said projection has a substantially cylindrical shape.

25. The injector of claim 24 wherein said cylindrical projection has a beveled lowermost edge.

26. The injector of claim 24 wherein said cylindrical projection has a rounded lowermost edge.

27. The injector of claim 20 wherein said projection has a substantially conical shape.

28. The injector of claim 27 wherein said conical projection is a portion of the frustrum of a cone.

29. The injector of claim 27 wherein said conical projection is a portion of a cone including the apex of said cone.

30. The injector of claim 20 wherein said projection has a substantially hemispherical shape.

31. A high pressure fuel injector of a type driven by a cam which cyclically imparts a varying downward speed to the injector in an injection cycle including an initial high cam speed portion and a subsequent lower cam speed portion, for injecting fuel into the combustion chamber of an internal combustion engine, comprising:

an injector body having a central bore and an injection orifice located at the lower end of said injector body and communicating between said central bore and the combustion chamber;

upper and lower plungers mounted for reciprocating movement within said central bore, the upper plunger having a top surface adapted to receive downward force from said cam, said upper plunger also having a bottom surface;

hydraulic timing means for varying the timing of the injection of metered fuel, said hydraulic timing means including a collapsible timing chamber for holding timing fluid, said chamber disposed below said upper plunger and above said lower plunger;

a passage formed centrally axially in a plunger surface at the bottom of said collapsible timing chamber for receiving said timing fluid during collapse of said timing chamber, said passage containing a flow constricting portion with a central control orifice, the diameter of said central control orifice regulating timing fluid spill flow during said high cam speed portion of the cycle; and a projection extending from the bottom of the upper plunger which interacts with said passage to regulate timing fluid spill flow through said passage during said lower cam speed portion at the end of the injection cycle.

32. The injector of claim 31 wherein said projection has a substantially cylindrical shape.

33. The injector of claim 32 wherein said cylindrical projection has a beveled lowermost edge.

34. The injector of claim 32 wherein said cylindrical projection has a rounded lowermost edge.

35. The injector of claim 31 wherein said projection has a substantially conical shape.

36. The injector of claim 35 wherein said conical projection is a portion of the frustrum of a cone.

37. The injector of claim 35 wherein said conical projection is a portion of a cone including the apex of said cone.

38. The injector of claim 31 wherein said projection has a substantially hemispherical shape.

39. The injector of claim 31 wherein said projection is located on said upper plunger and said passage is located on said lower plunger.

40. The injector of claim 31 further comprising an intermediate plunger between and moving relative to said upper plunger and said lower plunger, wherein said passage is located in said intermediate plunger and said projection extends from a lower surface of said upper plunger.

41. The injector of claim 40 wherein said passage is located centrally axially in said intermediate plunger.

* * * * *